United States Patent [19]

Maruyama

[11] 3,993,051

[45] Nov. 23, 1976

[54] BED

[76] Inventor: Shinjiro Maruyama, 15-2, Honjukucho 2-chome, Fuchu, Tokyo, Japan, 183

[22] Filed: Jan. 26, 1976

[21] Appl. No.: 652,457

[30] Foreign Application Priority Data

Feb. 8, 1975 Japan ..... 50-016547

[52] U.S. Cl. ..... 128/24 R; 128/70; 5/62

[51] Int. Cl.[2] ..... A61H 1/00; A61G 7/00

[58] Field of Search ..... 5/62, 64, 66, 365, 327; 272/98; 248/188.2; 128/24 R, 70

[56] References Cited

UNITED STATES PATENTS

| | | | |
|---|---|---|---|
| 2,696,207 | 12/1954 | Bushnell | 128/24 R |
| 2,808,828 | 10/1957 | Rubin | 128/24 R |
| 3,060,925 | 10/1962 | Honsaker | 128/24 R |
| 3,530,514 | 9/1970 | McCalley | 5/66 |
| 3,916,882 | 11/1975 | Jameson | 128/24 R |

FOREIGN PATENTS OR APPLICATIONS

| | | | |
|---|---|---|---|
| 854 | 1893 | United Kingdom | 128/70 |

*Primary Examiner*—Paul R. Gilliam
*Assistant Examiner*—Andrew M. Calvert
*Attorney, Agent, or Firm*—Beveridge, DeGrandi, Kline & Lunsford

[57] ABSTRACT

The invention provides a bed which, when an individual lies down upon it, allows him to take the "Yoga Slant Position" — with the head lower than the feet — through its automatic tilting operation, which gently returns the bed to its normal horizontal position after a short time. The bed is supported by a pair of hydraulic support means disposed respectively at the front and rear section, each oil chamber of the hydraulic support means being connected to an oil chamber of an oil tank which is provided separately, via a variable throttle valve.

6 Claims, 15 Drawing Figures

BED

BACKGROUND OF THE INVENTION

This invention relates to a bed for practising the body slant exercise to maintain and promote good health by the use of one's body weight.

It has for long been recommended that the "Yoga Slant Position", that is, the body slant position with the head being retained lower than the feet, is effective in fighting and recovering from fatigue of the spune and internal organs. The Yoga Slant Position is also believed to be effective in promoting good blood circulation. To practise the Yoga Slant Position, however, various inconveniences must be overcome such as specific apparatuses, skill and labor in manipulation of the apparatuses, floor space requirement therefor, and so forth. Because of these and other inconveniences, the Yoga Slant Position has not been widely practised conventionally despite its reputed effectiveness.

As a remedial practice for a spinal or sciatic disorders, attaching weights to the body of a patient lying prone on a bed in order to stretch his body has been conventionally practices. This method, however, entails inevitable risks involved in attaching weight to a patient's body, and preparing various weights to match with the condition of patients illnesses is a problem.

SUMMARY OF THE INVENTION

It is therefor an object of the present invention to provide a bed which allows one to take the "Yoga Slant Position" with the head lower than the feet in an extremely easy manner through tilting operation of the bed which resumes its normal horizontal position after a predetermined period of time, e.g., after 30 minutes.

It is another object of the invention to provides a bed which employs only an individuals own weight but no other driving sources at all for tilting operation thereof.

It is still another object of the invention to provide a bed which, after having once tilted subsequently resumed its normal horizontal position.

It is a further object of the invention to provide a bed which when tilted, naturally imparts a stretching force to the body of the individual lying prone thereon, said stretching force being exclusively generated by the weight of the body but by no other means such as weights of an artificial nature.

It is still a further object if the invention to provide a bed which can also be used as an ordinary bed, that is, which allows one to sleep thereon as in an ordinary bed after having tilted and resumed the normal horizontal position once or twice as mentioned above.

Similarly, it is still a further object of the present invention to provide a bed which, when one leaves it in the morning, automatically resumes its horizontal position and which allows one to practise exercises for promotion of health or for the remedy of disorders without specific skills, endeavours, time, or a floor space requirement.

BRIEF DESCRIPTION OF THE DRAWING

These and other objects, features and advantages of the present invention will become more apparent from the detailed description of preferred embodiments thereof taken in connection with the accompanying drawings, in which.

DESCRIPTION OF THE PREFERRED EMBODIMENTS

Figure 1:
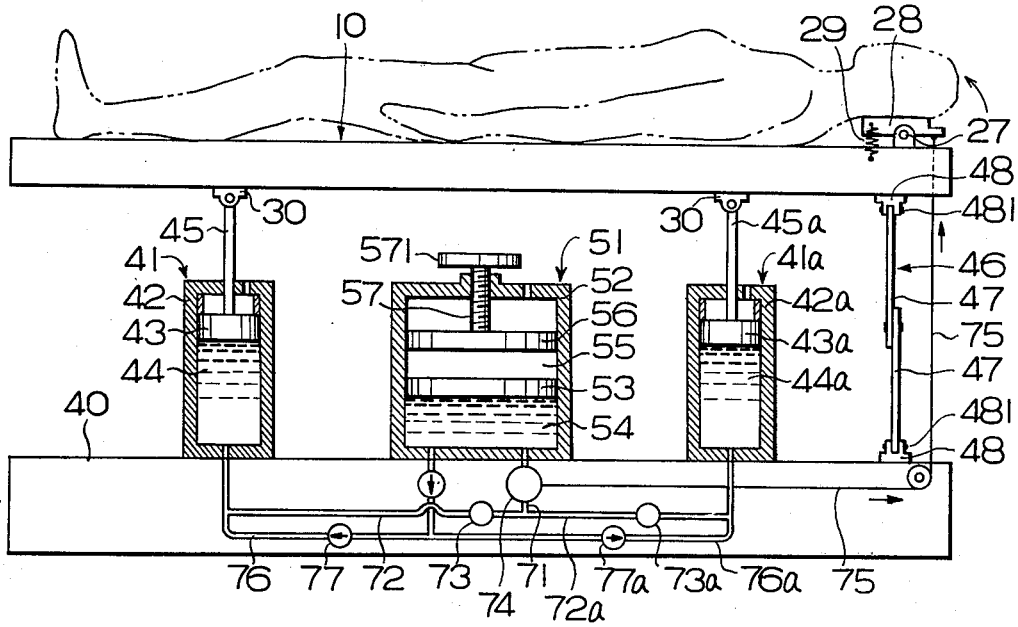
FIG. 1 is a partially vertical cross-sectional view of the bed in accordance with a first embodiment of the invention.
Figure 2:
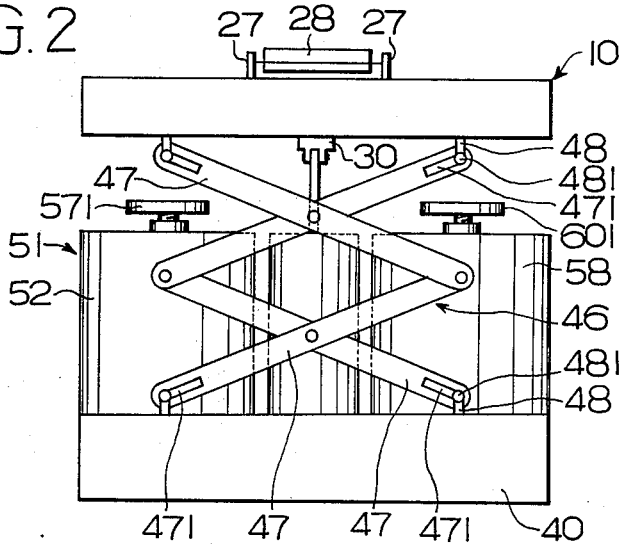
FIG. 2 is a side view of the bed shown in FIG. 1 as viewed from the right side thereof.

In FIGS. 1 and 2, a bed frame is indicated by the reference numeral 10. For the ease of explanation, the bed end of the bed frame is shown situated on the right side, and the foot end on the left, as also indicated by imaginary lines. A pillow support 28 is supported at the front end of the bed frame 10 considerably spaced apart from the upper surface of the bed frame by support plates 27, 27, and is tiltable back and forth to a certain extent. The pillow support 28 is, for the most part, horizontally retained by a spring 29.

The reference numeral 40 denotes a base onto which a pair of hydraulic support means 41 and 41*a* are adapted to support the bed frame 10 at both the front and rear sections. Since the hydraulic support means 41 and 41*a* have the same construction, explanation will hereinafter be given only on one of said means 41. A cylinder 42 is vertically erected on the base 40, and incorporates a piston 43 as well as an oil chamber 44 defined below the piston 43. The upper end of a piston rod 45 is fixed by a pin to a metal member 30 which is secured to the lower surface of the bed frame 10.

A balance mechanism 46 functions to prevent the bed frame 10 from tilting in the transverse direction relative to the head and foot ends of the frame. In other words, it prevents an individual from falling off from the sides of the bed.

The balance mechanism 46 is of a parallel motion mechanism known per se in the art. As shown in FIG. 2, for example, four links 47 of an equal length are assembled in a pantagraphic linking mechanism by pin-joints at the central position as well as both ends of each link 47. Longer holes 471 are bored respectively in the upper and lower ends of each link 47 so that horizontal pins 481 of metal members 48 are fitted into these holes 471 slidely, said metal members 48 being adapted so as to project into the lower surface of the frame 10 and to the upper surface of the bace 40.

The reference numeral 51 represents an oil tank 51 which is formed, for example, by dividing an air-tight vessel 52 (e.g. the cylindre erected on the base 40) into an oil chamber 54 at the lower section and a compressed air chamber 55 at the upper section by means of a separator 53. The separator 53 is capable of displacement while maintaining airtightness (such as, for example, a piston).

The internal volume of the compressed air chamber 55 is rendered variable in order to also vary the air pressure therein. Another piston 56 is disposed inside the compressed air chamber 55 in order to supply air as will herein be described in more detail. A screw rod 57 is secured to the upper portion of the piston 56, and projects outside from the vessel 52 in an upward direction. A handle 571 is fitted to the upper end of the screw rod 57 so that the piston 56 is caused to move vertically along with rotation of the handle 571.

A cylinder 58 for feeding compressed air (shown in FIG. 3) incorporates a piston 59 which is allowed to move vertically by rotation of a handle 601 of a screw rod 60 secured thereto. A lower chamber 61 of the cylinder 58 is communicated by a pipe 63 to an inlet port 62 positioned at the upper section of the airtight vessel 52 of the abovementioned oil tank 51. An air feed port 64 is disposed at the upper section of the cylinder 58.

Figure 3:
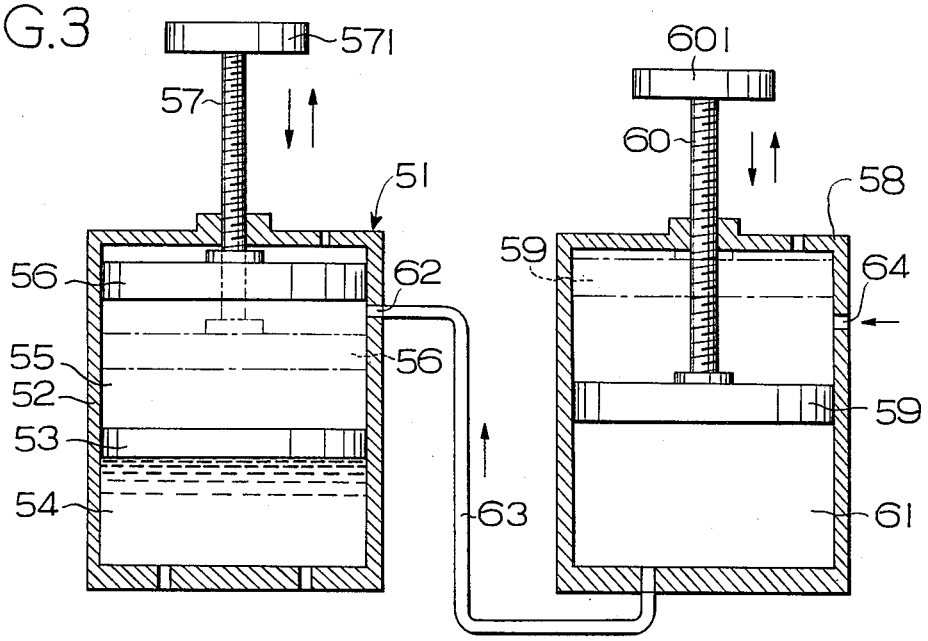
FIG. 3 is an enlarged schematic view of an air feed device.

Air is fed through the air feed port 64 while the piston 59 is maintained at a position indicated by dot-and-dash lines, and the piston 56 at a position of the full line (in FIG. 3). When the piston 59 is pushed down below the air feed port 64, the air inside the chamber 61 is compressed whereby the air pressure is also elevated in the air chamber 55. Next, when the piston 56 is pushed down below the air inlet port 62, the air is further compressed inside the air chamber 55.

Subsequently, a pipe 71 is connected to the oil chamber 54 of the oil tank 51 as shown in FIG. 1. The pipe 71 is branched at its top, one 72 being connected to the lower end of the cylinder 42 and the ither 72*a* tp the lower end of the cylinder 42*a*. These pipes 72 and 72*a* are provided respectively with variable throttle valves 73 and 73*a*.

The pipe 71 is also equipped with a manual switch valve 74 which is of a normally-closed type, and is opened when pulled by, for example, a piano wire 75. The piano wire 75 is incorporated in a helical tube (not shown), and the other end of the same is secured to the pillow support 27 passed through the bed frame 10 slidably. When the head of an individual is placed on the pillow of the pillow support 27, the support 27 rotates in the direction indicated by an arrow in FIG. 1, whereby the piano wire 75 is pulled, thereby opening the switch valve 74.

A pipe 76 connected the oil chamber 44 of the support-means 41 to the oil chamber 54, and a pipe 76 likewise connects the air chamber 44a to the oil chamber 54. These pipes 76 and 76*a* are provided with check valves 77 and 77*a* so as to allow the oil from the oil tank 51 to flow only in the direction of oil chamber 44 and 44*a*.

Next, the mode of operation of the bed frame in accordance with the above-described embodiment will be explained in the paragraphs which follow.

1. When an individual does not lie down on the bed, the pistons 43 and 43*a* of the hydraulic means 41 and 41*a* are kept at the uppermost position whereby the bed frame 10 is kept horizontal.

Figure 8:
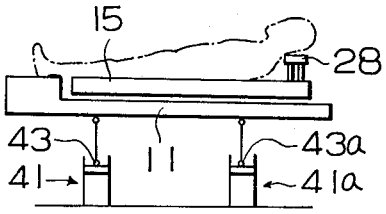
FIGS. 8–13 are schematic views showing the mode of the tilting operation of the bed frame.

2. Next, when an individual lies down on the bed frame 10 (on which a mattress or a cushion is placed) and places his head on the pillow support 27 (on which a pillow also is placed) as shown in FIG. 8, the valve 74 is caused to open. In consequence, the piston 43 and 43*a* are forced to move downward by the weight of the body, thereby feeding the oil from the oil chambers 44 and 44*a* to the oil tank 51. In this instance, the throttle valves 73 and 73*a* are regulated such that the descending speed of the piston 43 (on the foot-end side of the bed frame) is much slower than the ascending speed of the piston 43*a* (on the head-end side).

Figure 9:
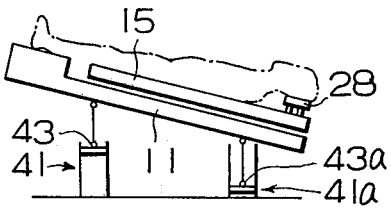
Figure 10:
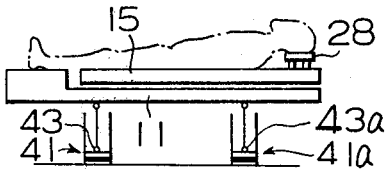

For example, when the throttle valves are so regulated as to allow the piston 43 and the piston 43*a* to reach the lowermost position in 10–30 seconds for the former and in about 30 minutes for the latter, the body of an individual on the bed frame 10 is brought into a slanted state ("Yoga Slant Position") as shown in FIG. 9. Subsequently, the foot end of the bed frame is lowered gradually, and within about 30 minutes, the bed frame 10 is placed again in a normal horizontal state as shown in FIG. 10.

3. Simultaneously with the abovementioned operation (2) the following action takes place in the hydraulic mechanism.

Namely, when the oil is transfered from the oil chambers 44 and 44*a* to the oil tank 51, the separator 53 (the lower piston) elevates to diminish the compressed air chamber 55, thus increasing the air pressure.

Figure 11:
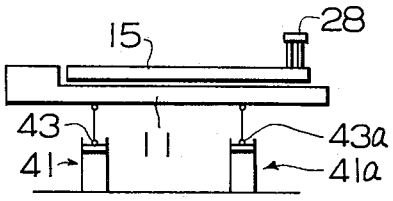

4. When an individual leaves the bed frame, the pillow support 27 resumes a normal horizontal position whereby the valve 74 is closed. On the other hand, the separator 53 is pushed downward by the air pressure of the air chamber 55. Accordingly, the oil of the oil chamber 54 flows back to the oil chamber 44 and 44*a* via the check valves 77 and 77*a*, and pushes the pistons 43 and 43*a* upward to restore the bed frame to the starting horizontal position as shown in FIG. 11.

5. When the opening direction of the throttle valve 73 is reversed with respect to the throttle valve 73*a*, the bed frame is tilted in the direction opposite to the above-mentioned operation (that is, with the head end being higher than the foot end).

In the above-described embodiment, the balance mechanism 46 may, if desired, be replaced by the four hydraulic support means 41.

Another embodiment of the present invention will next be explained with reference to FIG. 4.

Figure 4:
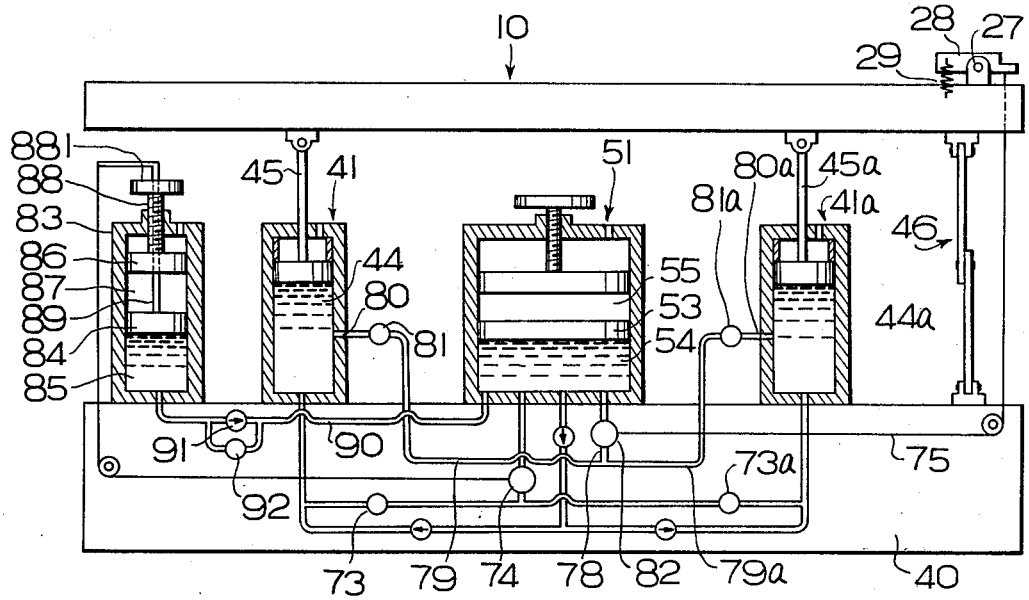
FIG. 4 is a partially vertical cross-sectional view of a bed in accordance with a second embodiment of the invention.

As shown in FIG. 4, another pipe 78 is disposed at the bottom of the oil tank 51, and branched to pipes 79 and 79*a*. These pipes 79 and 79*a* are connected respectively to the intermediate positions 80 and 80*a* of the same height of the oil chamber 44 (of the hydraulic means 41) and the oil chamber 44*a*. These pipes 79 and 79*a* are provided, respectively, with throttle valves 81 and 81*a*, while a switch valve 82 is fitted to the pipe 78 so that it is opened when pulled by a piano wire 75 (interlocked with the pillow support 27) in the like manner as is in the aforementioned embodiment.

Another switch valve 74 may be operated either manually or automatically by use of automatic means to be described later.

Namely, a cylinder 83 is adapted to an optional position of the base 40 (on the left side in FIG. 4), and two pistons 84 and 85 are incorporated therein to define an oil chamber 85 below the piston 84, and a compressed air chamber 87 between the piston 84 and 86. A screw rod secured to the upper piston 86 which has a handle 881 at the top thereof. hence, manipulation of the handle 881 causes the vertical motion of the piston 86 to optionally vary air pressure inside the air chamber 87.

On the other hand, a rod 89, secured to the lower piston 84, passes through the upper piston 86 and the screw rod 88 slidably as well as air-tightly. The upper end of this rod 89 is interlocked with the switch valve 74 by a piano wire, for example, in such a fashion that when the lower piston 84 elevates to a predetermined position against the air pressure inside the air chamber 87, the switch valve 74 is pulled by the piano wire, and caused to open.

A pipe connecting the oil chamber 85 to the oil chamber 54 of the oil tank 51 is provided with check valve 91 and a variable throttle valve 92 disposed in parallel. Thus, oil flow is free from the oil chamber 85 to the oil tank 51, but the reverse oil flow is limited to only a small amount by the throttle valve 92.

The mode of operation of the bed in this embodiment is as follows.

1. When an individual lies down on the bed frame and places his head on the pillow, the piano wire 75 is pulled to open the valve 82 in a manner similar to that in the first embodiment. When the throttle valves 81 and 81*a* are opened to substantially the same degree as in the first embodiment, the bed frame is tilted from the state shown in FIG. 8 to the state shown in FIG. 12, and thereafter maintains the state shown in FIG. 13. Note that in FIG. 13, the piston 41 and 41*a'* are stopped midway. In other words, the bed frame stops descending at a position where these pistons 41 and 41*a* close the outlet ports 80 and 80*a* of the oil.

2. Simultaneously with the abovementioned operation of the bed frame mentioned in the paragraph (1), the separator 53 of the oil tank 51 causes elevation. Simultaneously a portion of the oil inside the oil tank 51 passes through the pipe 90, and fed to the oil chamber 85 in extremely small amounts that are controlled by the throttle valve 92. In consequence, the piston 84 is forced to move upward, thereby opening the valve 74 at a predetermined position as mentioned in the foregoing paragraph.

3. Accordingly, the bed frame is finally placed horizontally as shown in FIG. 10 via the state shown in FIG. 9 in the same way as in the first embodiment.

4. When an individual leaves the bed, the bed frame resumes its normal horizontal position as shown in FIG. 11. In this instance, the piston 80 also descends to the starting position by the force of the compressed air inside the air chamber 87, and the oil of the oil chamber 85 flows back to the oil tank 51.

The third embodiment of the present invention contemplates to impart a pulling force to the body of an individual ehen he lies down on the bed frame tilted in a manner as in the aforementioned two embodiments. The construction of the bed frame in this embodiment is substantially similar to the aforementioned two embodiments except that the structure of the frame 10 per se is somewhat different.

Figure 6:
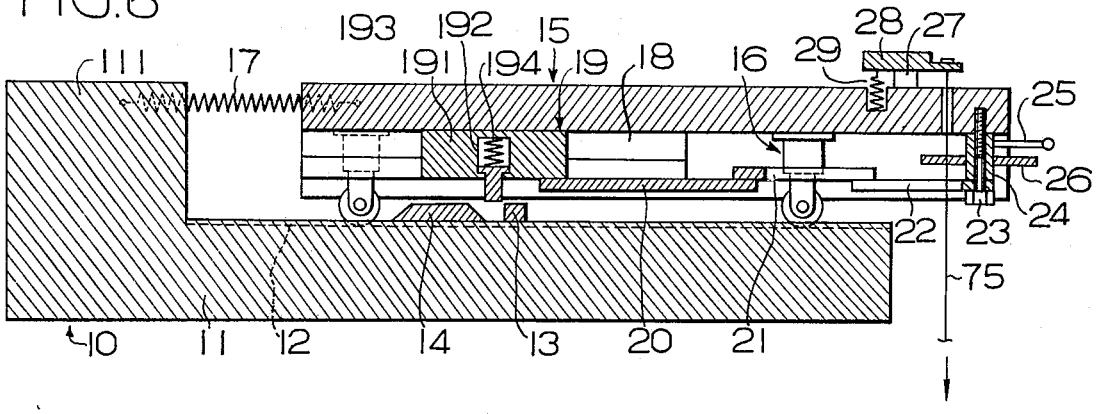
FIGS. 6 and 7 are sectional view of the portions taken respectively along the lines VI—VI and VII—VII of FIG. 5.
Figure 7:
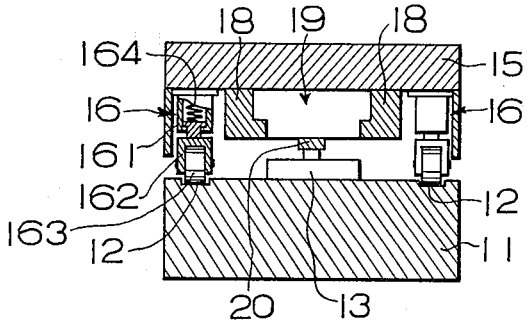
Figure 5:
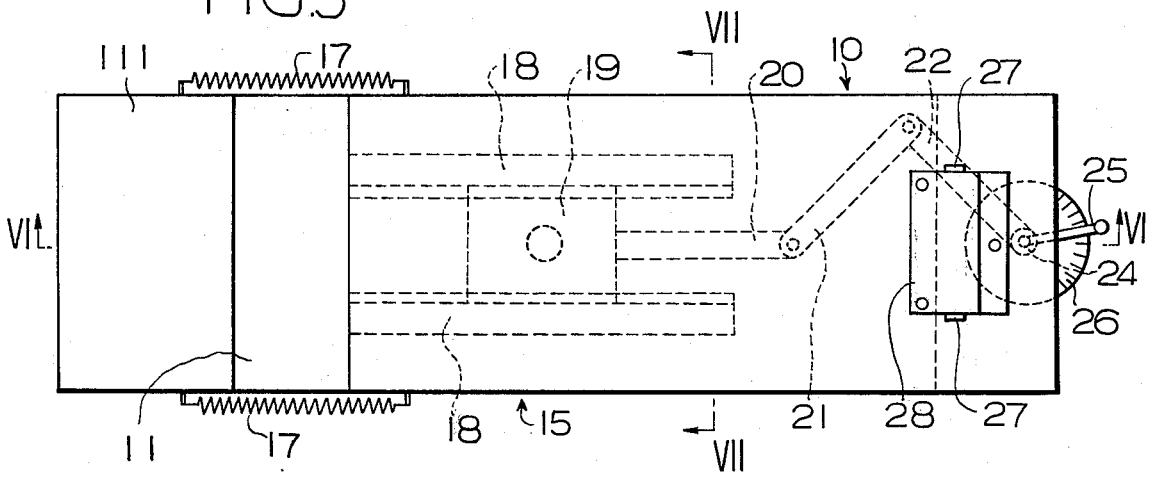
FIG. 5 is a plan view of the bed frame in accordance with a third embodiment of the invention.

In FIGS. 5 through 7, the bed frame 10 consists principally of a main body 11 and a moving frame 15 which is movable back and forth above the main body11. The main body 11 is of a flat square, and a leg 111 thereof is higher than the other parts (FIG. 6). Guide gutters 12, 12 are bored in both the front and rear sections of the main body 11 as shown in FIG. 7. Stoppers 13 and 14 also are disposed projectively at the central positions of the main body 11.

The moving frame 15 has a flat square shape, and is provided with four castors 16 the detail of which is illustrated in FIG. 7. That is to say, a small cylinder 161 is secured to the lower surface of the frame 15. The upper section of a metal fitting 162 of a wheel 163 is fitted into the small cylinder 161 in such a fashion as to be vertically slidable therein but not subject to falling. A compression spring 164 is interposed between the cylinder 161 and the fitting metal 162. The wheels 163 travel on the guide gutters 12, 12. When an individual lies down on the bed frame 15, the moving frame 15 is lowered to thwewby press the spring 164. The moving frame is connected to the main body 11 by a tension spring 17.

On both sides of the lower surfaces of the moving frame 15, there are disposed guide frames 18 and 18 in the longitudinal direction in parallel with each other. These guide frames 18 slidably support there between an engaging member 19. A hole 192 is bored downwardly in a main body 191 of the engaging member 19 as shown in FIG. 6, and a pin 193 is fitted into this hole in such a manner as to be vertically slidable therein but not subject to falling, and interposes a compression spring 194 therebetween. Also, the rear end of the lever 20 is secured to this engaging member 19, while links 21 and 22 are sequentially pin-jointed to the front end of the lever 20. A bolt 23 is inserted into the lower surface at the front end of the moving frame 15. A cylindrical member 24 is rotatably fitted to this bolt 23, and the front end of the link 22 is secured to the member 24. Further, a handle 25 and a dial plate 26 are secured to the cylindrical member 24.

The apparatus of this embodiment operates in the following manner.

1. When the handle 25 is turned, the engaging member 19 is caused to move via the links 22 and 21 as well as the lever 20. The piston of the engaging member 19 is indexed by the dial plate 26.

Figure 12:
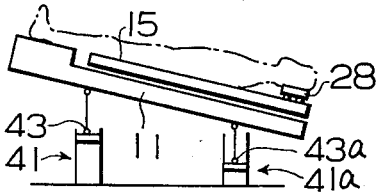
Figure 13:
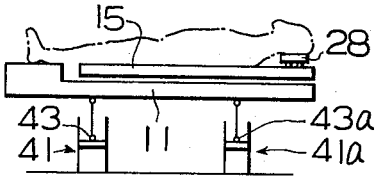

2. When the bed frame 10 as a whole is tilted (as shown in FIGS. 9 and 12), the moving frame 15 transfers the main body 11 forward against the force of the spring 17. If the legs of an individual are secured to the foot end section 111 of the main body 11, therefore, a stretching force is imparted to his body. The stretching force is expressed by the product of the weight of the person and the sine of the inclined angle. No additional weight is required in this instance.

3. When the moving frame 15 moves forwards, the pin 193 of the engaging member 19 engages with the stopper 13 whereby the moving frame 15 stops at this position. Accordingly, the distance of movement of the moving frame 15 is regulated by the position of the engaging member 19 (in accordance with instructions of a medical practitioner).

4. When an individual leaves the bed, the moving frame floats upwards to a certain extent by the action of the spring 164 incorporated in the leg 16 whereby the pin 193 detaches from the stopper 14, and resumes the normal horizontal position by the action of the spring 17.

Fourth embodiment of the invention

There will be a difficulty in the downward movement of the bed frame 10 with a child or very light weight individual if the pressure is lowered excessively inside the compressed air chamber 55 of the oil tank 51. With a lowered pressure in the compressed air chamber 55, however, there will be another difficulty in restoring the original position of the bed frame 10 after the individual leaves the bed frame 10.

These difficulties may be solved by using an oil tank 51 of very large capacity. As an alternative solution, however, the pump 94 may be operated only for restoring the position of the bed frame 10 as illustrated in FIG. 14 and 15.

Figure 14:
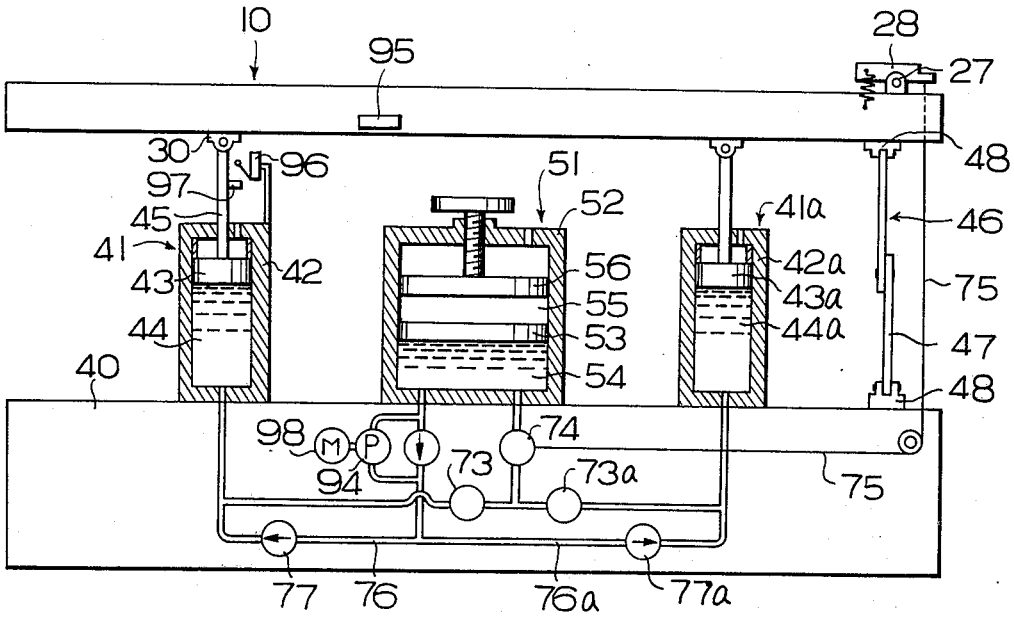
FIG. 14 is a partially vertical cross-sectional view of the bed in accordance with a fourth embodiment of the invention.
Figure 15:
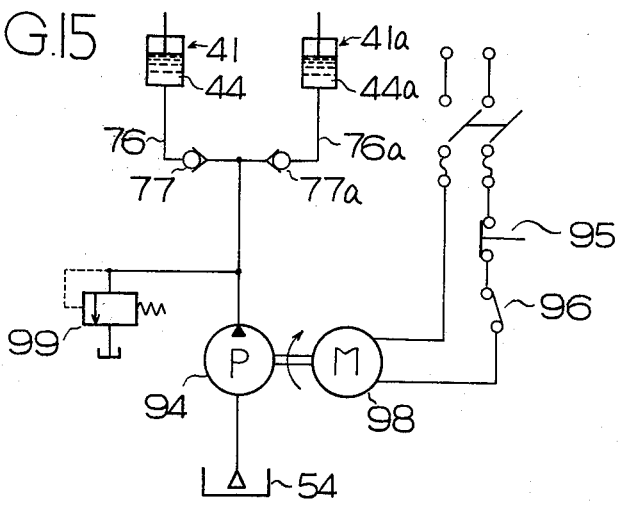
FIG. 15 is a schematic electric and hydraulic circuit in accordance with a fourth embodiment of the invention.

The pump 94 is connected between the oil chamber 54 of the oil tank 51 and the branching point leading to the pipes 76 and 76*a* as shown in FIG. 14. In addition, the pressure switch 95 is mounted at the most favorable location over the bed frame 10. This switch 95 is of normally-closed type and turned off when an individual lies down on the bed frame 10. Another normally-closed type limit switch 96 is mounted on the upper portion of the cylinder 42 via a suitable support member. The reference numeral 99 in FIG. 15 represents a relief valve.

The operational mechanism is described below.

If an individual lies down on the bed frame 10, the pressure switch 95 is turned off and the bed frame 10 is lowered in level while tilting as aforementioned.

When the individual leaves the bed frame 10, the pressure switch 95 is turned on and the electeic motor 98 in FIG. 15 then starts to rotate to operate the pump 94 so that the oil in the oil chamber 54 is fed to both the oil chambers 44 and 44*a*. The bed frame 10 is thereby elevated to reach its uppermost level, when the dog 97 that is secured to the piston rod 45 touches the limit switch 96. the limit switch 96 is then turned off to stop the electric motor 98.

Since numerous changes may be made in the abovedescribed apparatus and different embodiments of the invention may likewise be made without departing from the spirit and scope thereof, it is intended that all the matters contained in the foregoing description or shown in the accompanying drawings shall be interpreted as illustrative and not in a limiting sense.

What is claimed is:

1. A bed comprising the combination of;

a bed frame;

a base;

a pair of hydraulic support means disposed respectively at the front and rear section of said base, each of said hydraulic support means consisting essentially of a cylinder erected vertically on said base, a piston incorporated in said cylinder, an oil chamber defined below said piston, and a piston rod the upper end of which is connected to said front or said rear section of said base;

an oil tank including a separator capable of displacement inside an airtight vessel erected on said base so as to divide it into an oil chamber and a compressed air chamber while maintaining airtightness; and a pair of pipes, each being equipped with a variable throttle valve and connecting said oil chamber of said oil tank to the bottom of each oil chamber of said hydraulic support means.

2. The bed as defined in claim 1 wherein said bed frame is connected to said base by a pantagrahic link mechanism such that said bed frame maintains a parallel relationship with said base in a plane perpendicular to the longitudinal direction of said bed frame.

3. The bed as defined in claim 1 wherein said oil chamber of said oil tank is connected by pipes to said oil chamber of said hydraulic means at the position of an intermediate height on the same plane, each of said pipes provided with a variable throttle valve.

4. The bed as defined in claim 3 including:

a manual switch valve provided on each said pipes connecting said oil chamber of said oil tank to said oil chamber of said hydraulic support means;

said cylinder being erected on said base, and having a piston defining an oil chamber at the lower portion thereof and a compressed air chamber at the upper portion;

a pipe connecting the bottom of said oil chamber of said piston to the bottom of said oil chamber of said oil tank via a variable throttle valve; and link means connecting said manual switch valve to the upper end of said piston rod penetrating slidably and in as airtight condition through said cylinder in a fashion such that when said piston reaches a predetermined height, said manual switch valve is caused to open by the action of said link means.

5. The bed as defined in claim 1 further comprising:

a main body constituting said bed frame;

a moving frame constituting said bed frame jointly with said main body and moving back and forth thereabove;

a plurality of springs connecting said main body to said moving frame;

at least one stopper member disposed on the upper surface of said main body; and at least one pin member disposed on the lower surface of said moving frame to engage with said stopper member, either said stopper member or said pin member being displacable back and forth.

6. The bed as defined in claim 1 wherein the inlet of said pump is connected to said oil chamber of said oil tank and the outlet of said pump is connected to each oil chamber of said hydraulic support means via a check valve that allows oil to flow only from said pump to said oil chamber of said hydraulic support means.

* * * * *